US010597190B2

(12) United States Patent
Hauser et al.

(10) Patent No.: US 10,597,190 B2
(45) Date of Patent: Mar. 24, 2020

(54) POURING ELEMENT FOR A COMPOSITE PACKAGING AND A COMPOSITE PACKAGING WITH A POURING ELEMENT

(71) Applicant: SIG Technology AG, Neuhausen am Rheinfall (CH)

(72) Inventors: Philippe Hauser, Andelfingen (CH); Felix Rigling, Dettighofen (CH); Markus Wassum, Buch (CH)

(73) Assignee: SIG Technology AG, Neuhausen am Rheinfall (CH)

( * ) Notice: Subject to any disclaimer, the term of this patent is extended or adjusted under 35 U.S.C. 154(b) by 0 days.

(21) Appl. No.: 16/097,360

(22) PCT Filed: May 5, 2017

(86) PCT No.: PCT/EP2017/060755

§ 371 (c)(1),
(2) Date: Oct. 29, 2018

(87) PCT Pub. No.: WO2017/207213

PCT Pub. Date: Dec. 7, 2017

(65) Prior Publication Data

US 2019/0144158 A1 May 16, 2019

(30) Foreign Application Priority Data

May 31, 2016 (DE) ..... 10 2016 110 047
Jun. 1, 2016 (EP) ..... 16020202

(51) Int. Cl.
*B65D 5/74* (2006.01)
*B65D 51/22* (2006.01)

(52) U.S. Cl.
CPC ..... *B65D 5/748* (2013.01); *B65D 51/226* (2013.01)

(58) Field of Classification Search
CPC ..... B65D 5/748; B65D 51/226
See application file for complete search history.

(56) References Cited

U.S. PATENT DOCUMENTS 9,738,427 B2 8/2017 Backes et al.
2005/0236425 A1 10/2005 Casale et al.
2005/0242113 A1* 11/2005 Weist ..... B65D 5/748 222/83.5
2006/0071000 A1 4/2006 Weist et al.
(Continued)

FOREIGN PATENT DOCUMENTS

CN 104411591 A 3/2015
EP 1396435 A1 3/2004
(Continued)

*Primary Examiner* — Jeremy Carroll
(74) *Attorney, Agent, or Firm* — The Webb Law Firm

(57) ABSTRACT

A pouring element for a composite packaging, in particular for a beverage carton for liquid food, comprising a fastening flange and a pouring tube, a cutting element arranged and guided in the pouring tube, first guide means formed in the pouring tube and second guide means formed on the cutting element, wherein the first and second guide means cooperate correspondingly, and a composite packaging, in particular a beverage carton for liquid foods, with a packaging gable panel suitable for accommodating a pouring element. The first guide means is formed by a surrounding and self-contained rib.

15 Claims, 5 Drawing Sheets

(56) References Cited

U.S. PATENT DOCUMENTS

Figure 1:
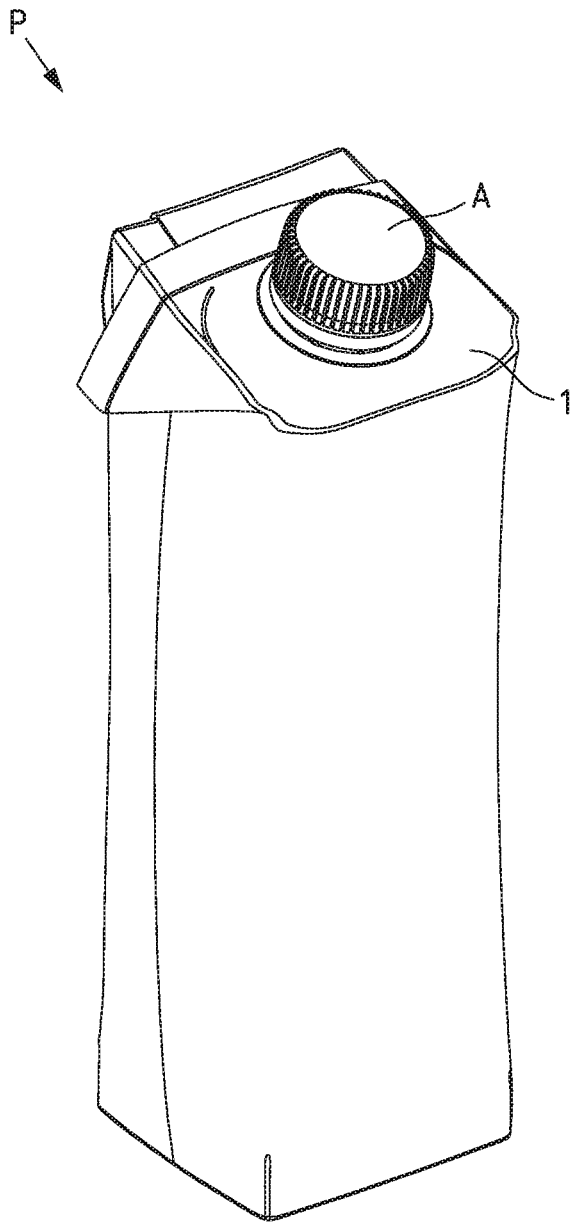

| | | | | |
|---|---|---|---|---|
| 2008/0210745 | A1 | 9/2008 | Rigling | |
| 2010/0264146 | A1* | 10/2010 | Casale | B65D 5/029 220/278 |
| 2010/0320209 | A1* | 12/2010 | Leuenberger | B65D 5/748 220/284 |
| 2012/0181281 | A1* | 7/2012 | Ott | B65D 5/748 220/277 |
| 2013/0256336 | A1* | 10/2013 | Himmelsbach | B65D 5/748 222/81 |

FOREIGN PATENT DOCUMENTS

| | | | |
|---|---|---|---|
| EP | 2055640 | A1 | 5/2009 |
| WO | 2003/101843 | A1 | 12/2003 |
| WO | 2004/000667 | A1 | 12/2003 |
| WO | 2007/115978 | A1 | 10/2007 |
| WO | 2009/068671 | A1 | 6/2009 |

* cited by examiner

POURING ELEMENT FOR A COMPOSITE PACKAGING AND A COMPOSITE PACKAGING WITH A POURING ELEMENT

CROSS-REFERENCE TO RELATED APPLICATIONS

This application is the U.S. national phase of International Applications No. PCT/EP2017/060755 filed May 5, 2017, and claims priority to German Patent Application No. 10 2016 110 047.1, and European Patent Application No. 16020202.4, filed May 31, 2016, and Jun. 1, 2016, respectively, the disclosures of which are hereby incorporated in their entirety by reference.

The invention relates to a pouring element for a composite packaging, in particular for a beverage carton for liquid foods, with a basic body comprising a fastening flange and a pouring tube, a cutting element arranged and guided in the pouring tube, first guide means formed in the pouring tube and second guide means formed on the cutting element, wherein the first and second guide means cooperate correspondingly, and also a composite packaging, in particular a beverage carton for liquid foods, with a packaging gable panel suitable for accommodating a pouring element.

In the field of packaging technology composite packagings have long been part of the prior art. Thus, beverage cartons for example consist of various packaging materials such as paper and plastics, which when joined over their solid area and printed form a packaging laminate. The layer structure can vary depending on requirements, so that for example for aseptic contents an aluminium layer is additionally incorporated in order to achieve a good barrier effect against gases and light. Often—but not always—the laminate is also cut to the size of the packaging during its production and in this way so called packaging pre-cut parts (blanks) are formed. Alternatively the packaging laminate is also supplied as an endless material (rolled goods) and is only later cut to size.

The actual forming and filling of the packaging and closing of the latter to produce a container takes place in a packaging machine, which because of its main functions is often also called a form/fill/seal machine. Typical contents are mainly liquid foods, such as for example beverages, soups or yoghurt. Thickened, pasty or lumpy products or the like are also conceivable.

Packagings of the aforementioned type are sometimes also provided with pouring elements. Apart from allowing a controlled pouring, these as a rule also provide for the possibility of re-closure. Not infrequently, and principally with aseptic use, a first-opening function for the packaging is also envisaged. In this case the previously gastight sealed packaging is opened for the first time. This can take place for example by means of a ring pull or a pull tab or also by means of a piercing and/or cutting device. Such piercing and/or cutting devices are often formed as sleeve-shaped cutting elements (cutting rings), which are coupled for example to the screw cap via drive means, so that by means of the rotational actuation of the screw cap the packaging is simultaneously cut open.

European patent application EP 1 396 435 A1 shows for example a three-part pouring element. The basic body, screw cap and cutting sleeve are first of all manufactured individually in an injection moulding process and when assembled together form a functioning pouring element, which via a fastening flange on the basic body can remain connected to a filled composite packaging described above. When the screw cap is actuated by the consumer for the first time the cutting element moves in the direction of a weakened section specially provided in the composite packaging and cuts through this by means of a plurality of cutting teeth.

The conversion of the screw cap movement into a rotationally concurrent and translationally opposite cutting element movement is realised by a corresponding thread on the components. The positively projecting thread flank of the cutting element meshes at the same time over a larger section in the negative thread flank of the basic body. This makes possible on the one hand a relatively reliable guidance of the components—which is always desirable—but restricts the kinematics of the cutting element to a constant forward movement. This can be a disadvantage however, since with packagings of the aforementioned type a so called "PE tearing" can occur in the cutting procedure. In this case the polyethylene foil stretches without tearing, which results in a poor or even incomplete opening, so that the product cannot be poured out in the required manner. The special tooth geometry is said to help solve the problem. Furthermore such parts are relatively complicated to manufacture, since for example thread undercuts complicate the removal of the injection moulded parts from the injection moulding machine.

An improved three-part pouring element is shown in international patent application WO 2004/000667 A1 belonging to the applicant. The invention makes possible a graduated kinematics of the cutting element. This is first of all moved forward in a purely axial direction and the composite packaging is thus pierced by a combined piercing and cutting device. This is followed by a rotation that allows the device to execute exclusively a cutting action.

In order to make possible this special kinematics, relatively large size guidance and force transmission means are necessary. In addition large wall thicknesses of the components have to ensure the necessary rigidity and therefore also the functional reliability. Such arrangements however involve high levels of material consumption and increase the cycle times in the injection moulding.

To improve the injection moulding production and the assembly of the thereby fabricated parts, disclosed in international patent application WO 2009/068671 A1 belonging to the Applicant is a one-part fabrication of base element, cutting element and screw cap. The cutting element is already substantially shaped to start with in its initial position in the tube of the base element and the screw cap is joined to the base element via a connection piece. For the assembly, it is sufficient to take the injection moulded parts. If the consumer now wishes to pour the product from the composite packaging, he actuates the screw cap of the pouring element that is now applied to an aforementioned composite packaging and severs for the first time the connection piece (this thus also serves as temper-proof seal) and initiates the movement of the cutting element.

The kinematics of the cutting element are determined by the guide strips formed in the pouring tube, in which guide ribs on the cutting element engage. To start with this follows a steeper screw movement and then transforms into a smoother screw movement. After the packaging has been pierced the cutting element is stopped in its end position via a recess and a stop means. This important function is necessary since otherwise there is a danger that the cutting element could fall into the product.

A further generic pouring element is shown in European application EP 2 055 640 A1. When the screw cap is twisted, a conversion of the rotational movement into a graduated movement of the cutting element takes place. This is realised by a complicated construction via a negatively profiled notch on the cutting element and lobes projecting on the inner wall of the pouring tube and engaging in the notch. The components are relatively complicated to manufacture and can be produced only with a high material expenditure.

Against this background it is the object of the present invention to devise and develop a pouring element and a composite packaging of the type mentioned in the introduction and described hereinbefore so that the afore-described disadvantages can be overcome. In particular the production should be optimised as regards material and fabrication aspects and the opening function for the composite packaging should still be fully ensured.

This object is achieved with a pouring element according to the preamble of claim 1, in that the first guide means is formed by a surrounding and self-contained rib. Such a rib makes possible a comprehensive freedom of design of the guide means in order to achieve a desired cutting element kinematics. In particular a graduation of the rotational and axial movement components or variable axial feed components can be realised. The complete rotation of the rib guarantees a reliable guidance of the cutting element. This avoids in particular the danger that the cutting element also in the case of loads, for example from the action of forces and torques of the cutting process, cannot escape from its forced guidance, since this has no limiting ends. A surrounding rib avoids undercuts (such as for example in the case of threads), so that plastic parts regularly produced in an injection moulding method can easily be removed from the moulds. This allows a simpler and therefore more cost-effective arrangement of the mould halves, simplifies the filling of the cavities, and thus shortens the injection cycle times, all of which optimises the overall production. The restriction to one rib also saves material. A self-contained rib furthermore increases the rigidity and strength of the basic body, so that the guide means can fulfil its function and a good and reliable opening is made possible. Since the strength and rigidity are guaranteed, wall thicknesses can also be optimised (i.e. reduced), thereby creating a further potential for material saving. Such a lightweight construction is however of great importance, in particular in mass production of for example casting elements.

The object forming the basis of the invention is achieved also by a composite packaging, wherein the packaging gable panel has a local packaging material weakness and such a casting element is positioned and permanently connected in such a way that, during the first actuation of the pouring element, the cutting element is movable in the direction of the packaging material weakness and this can be severed so that the composite packaging is ready for emptying the contents. The pouring element and composite packaging should always closely match to one another. Thus, an exact positioning on a packaging gable panel provided for this purpose is of decisive importance. On the one hand the pouring element must remain connected to the composite packaging, and on the other hand the cutting element should engage exactly in the packaging material weakness created for this purpose and sever the latter. Only this procedure allows a complete opening of the packaging, which is then ready for the emptying of the contents.

A further teaching of the invention envisages that for the initial position of the cutting element the rib has at least one high level section. Such a high level section makes possible a reliable maintenance of the cutting element up to the initial opening of the composite packaging. This is necessary however, since otherwise the danger would exist that the composite packaging is prematurely damaged and would no longer be airtight, which could cause the contents to perish prematurely.

According to a further teaching of the invention the rib for the end position of the cutting ring has at least one low level section. A stopping of the cutting element in the end position serves for security, since then the cutting element can in no circumstances escape from the end position and in particular cannot fall into the product. If for example the cutting element is driven by a closure cap, this should also be prevented in the re-closure as well as in a renewed rotation, which is what the low level section ensures.

Further types of the embodiments according to the invention envisage that the rib has different pitches for different movements of the cutting element and/or that the rib has a further level for a pure rotational movement of the cutting element. Different movements of the cutting element may be desirable depending on the quality of the cut. If disadvantageous effects such as for example "PE tearing" are to be avoided, then it is recommended first of all to pierce (perforate) the packaging material and then cut it by means of a rotational movement, which is the purpose of the further level.

Another teaching of the invention envisages that the rib has between the high level section and low level section a section to prevent the cutting element falling out. Such an additional section encloses the rib completely and provides an additional security against the cutting element falling out.

In a further advantageous embodiment, the second guide means is formed by cams arranged above the circumference of the cutting element. Such cams extend along the first guide means to a stop. Despite their material-saving construction (for example compared to webs), local cams allow their intended function to be fulfilled completely.

In further expedient embodiments the second guide means is formed as pairs of cams, which are arranged optionally as three pairs of cams distributed over the circumference of the cutting element. Such pairs of cams enclose the rib of the first guide means. This provides an additional restriction on the degrees of freedom of the forced guidance, so that this becomes more reliable and accurate. If three pairs of cams are arranged distributed over the circumference of the cutting element, an optimal compromise is obtained between material consumption and guide function.

A further embodiment of the invention envisages that at least one cam comes into contact via a rounded contour with the rib. Such a rounded contour enables varying pitches and different sections of the rib of the first guide means to be smoothly followed, without producing any tilting or large torques.

According to a further teaching of the invention a closure cap is connected to the basic body, which makes possible the re-closure of a composite packaging whose contents have been partially consumed.

In further arrangements of the invention the cutting element can be driven over drive flanks formed on the closure cap, which act on drive elements arranged on the cutting element. Thus, the first-opening rotational movement can be used to drive the cutting element ("single action"). If the drive is realised over flanks (on the cap) and webs (on the cutting ring), a particularly advantageous coupling is provided.

According to a particular embodiment of the invention the packaging material weakness is implemented as a prelaminated perforation. Such a special preparation of the packaging material is suitable specifically for the opening by a material-optimised and production-optimised pouring element, since the piercing does not have to take place through the full material of the composite packaging.

Figure 2:
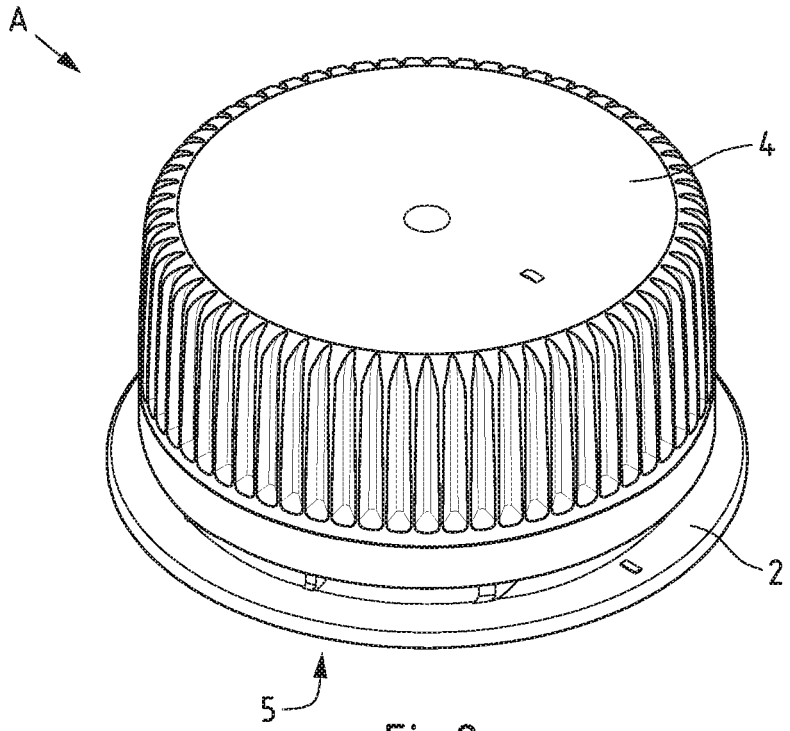
Figure 3:
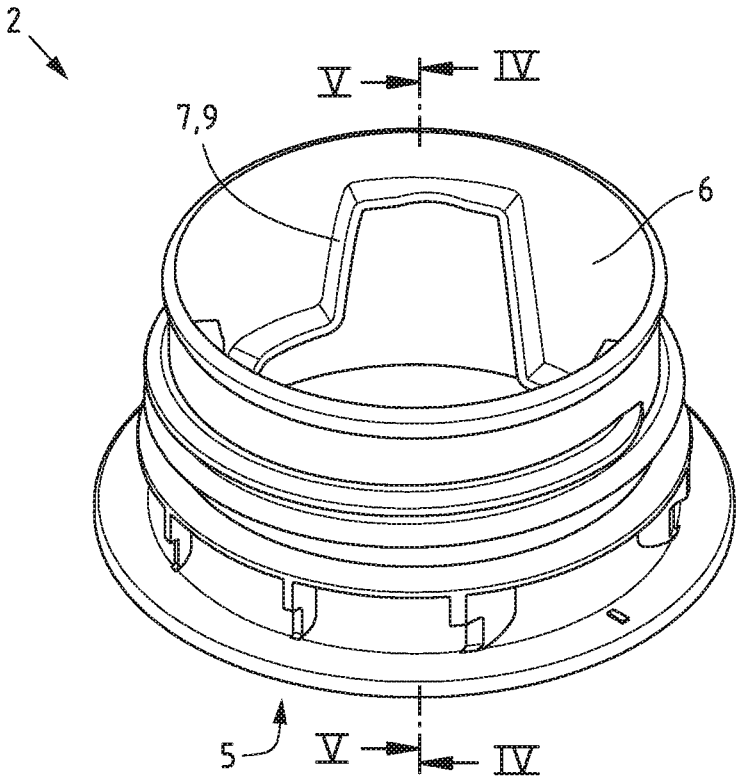
Figure 4:
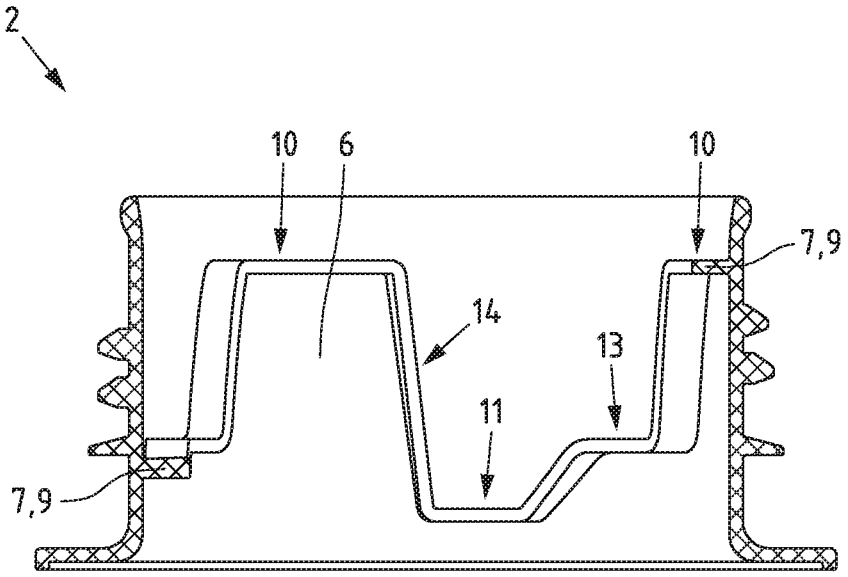
Figure 5:
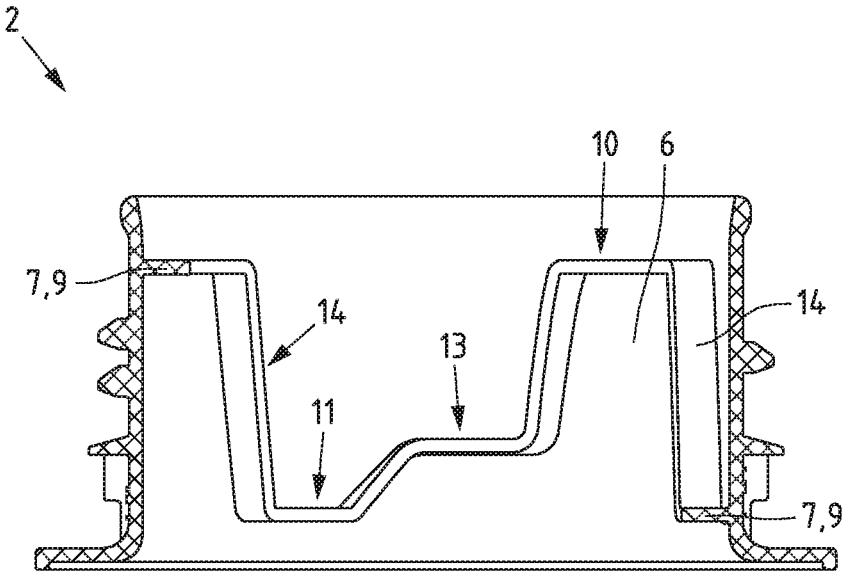
Figure 6:
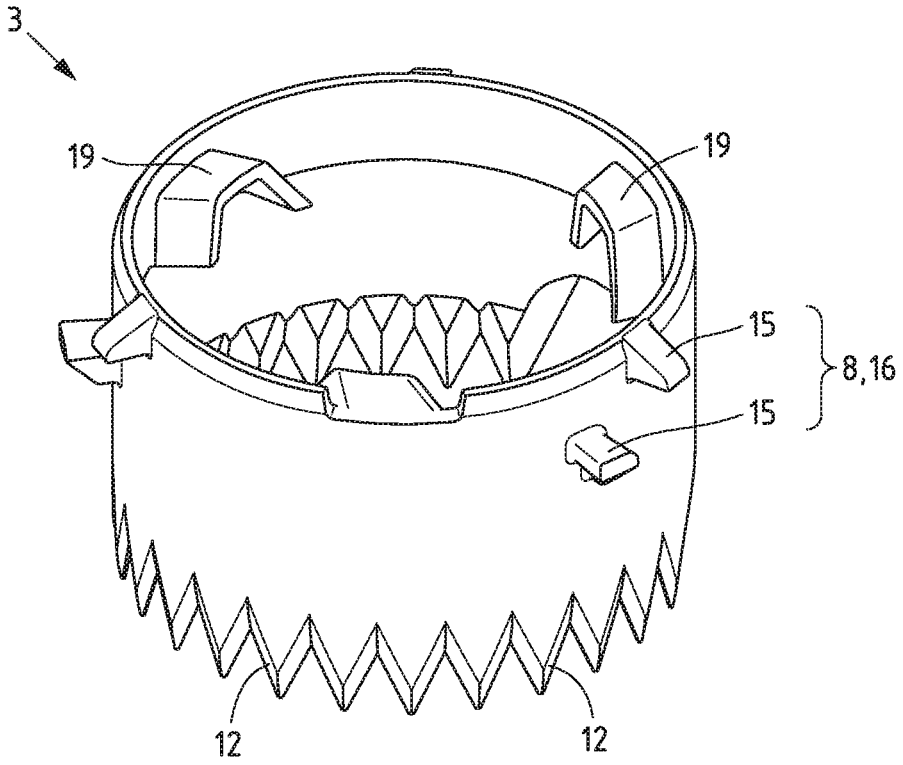
Figure 7:
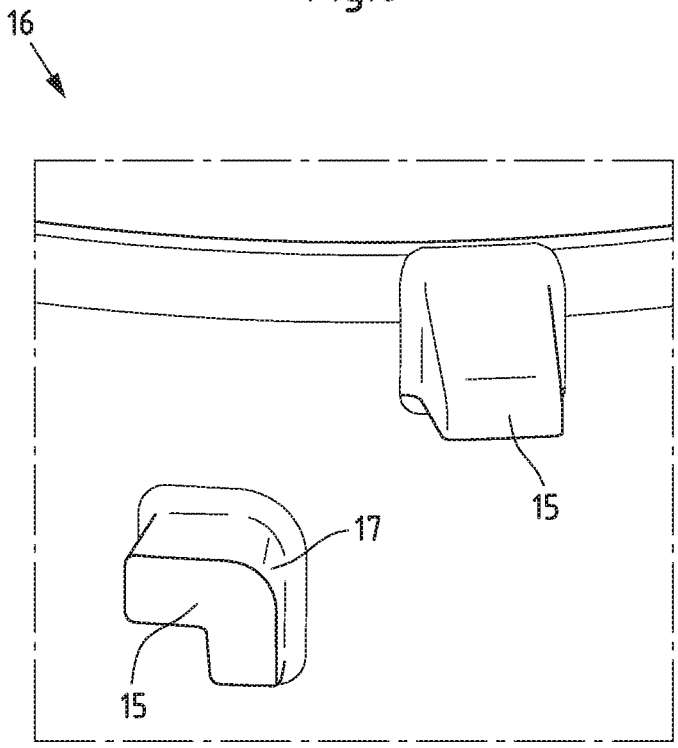
Figure 8:
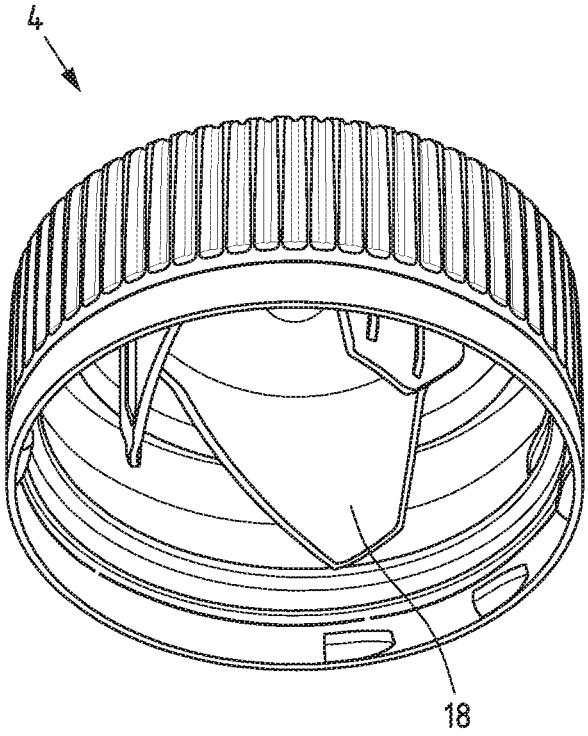

The invention is described in more detail hereinafter with the aid of the drawings simply illustrate one exemplary embodiment. In the drawings:

FIG. 1 shows a composite packaging according to the invention with a pouring element in a perspective view from the front and above, FIG. 2 shows a pouring element according to the invention in a perspective view from above, FIG. 3 shows the basic body of the pouring element from FIG. 2 in a perspective view from above, FIG. 4 shows the basic body of FIG. 2 in a vertical section along the line IV-IV, FIG. 5 shows the basic body of FIG. 3 in a vertical section along the line V-V, FIG. 6 shows the cutting element of the pouring element of FIG. 2 in a perspective view from above, FIG. 7 shows a pair of guide cams of the cutting element of FIG. 6 in a detailed view, and FIG. 8 shows the closure cap of the pouring element of FIG. 2 in a perspective view from inside.

The embodiment illustrated in FIG. 1 of a composite packaging P according to the invention shows this as a beverage carton. The composite packaging P consists of a packaging material, which forms a packaging laminate from a series of flat joined-together materials: polymer layers are laminated on both sides of a carton carrier layer and an additional aluminium layer screens the product in the composite packaging P against undesired environmental influences (light, oxygen).

The composite packaging P has in the edge region a packaging gable panel 1, to which is applied and permanently attached a pouring element A also according to the invention. When the pouring element A is actuated for the first time, a packaging material weakness region—here covered by the pouring element A—is severed and the composite packaging P is thereby opened for the first time, which is then ready for emptying the contents. This weakness region in the illustrated and thus preferred exemplary embodiment is implemented as an over-coated perforation, which is formed during production: for this, a hole is punched out of the carton carrier layer, so that after it has been coated over a local weakness is produced.

FIG. 2 shows the pouring element A according to the invention, whose parts individually produced in an injection moulding method are installed (assembled) ready for use: a basic body 2, a—in this case concealed—cutting element 3 (illustrated in FIG. 6) and a closure cap 4. The pouring element A that is now functionally ready for use is then applied via a fastening flange 5 to the composite packaging P and permanently connected by means of a hot-melt adhesive.

When the closure cap 4 is actuated for the first time by the consumer, the unscrewing movement of the closure cap 4 is transferred to the cutting element 3 guided in the basic body 2, which severs the composite packaging P in the region of the weakness. The product can then be poured out through the thus created opening.

The basic body 2 is illustrated in FIG. 3, which in addition to the fastening flange 5 also consists of a pouring tube 6. In the installed and functionally ready state the cutting element 3 is arranged in the pouring tube 6 and is forcibly guided over first guide means 7 formed on the inner wall of the pouring tube and thereby over corresponding second guide means 8 formed on the cutting element 3 (see FIGS. 6 and 7). The first guide means 7 is formed by a surrounding and self-contained rib 9.

FIGS. 4 and 5 show the vertically sectioned halves of the basic body 2 with the respective inner wall of the pouring tube 6, on which the outline of the projecting rib 9 is visible. The rib 9 has in the upper region a high level section 10, which forms the guide section for the initial position of the cutting element 3. If the cutting element 3 is now caused to move, this follows the first guide means 7 and is moved from the high level section 10 over a section of variable pitch to a low level section 11, where the end position of the cutting element 3 is reached. The actual opening process of the composite packaging P takes place between the high level section 10 and low level section 11. For this, the severing means 12 formed at the end on the cutting element 3 pierce and cut (see FIG. 6) the composite packaging P in the region of the over-coated perforation.

In the illustrated and thus preferred embodiment a further level 13 is formed between the high level 10 and low level section 11 on the rib 9, which produces a pure rotation of the cutting element 3, whereby over this region the severing means 12 cut instead of pierce the over-coated perforation.

When the cutting element 3 has reached its end position, it should be stopped at this position. In order to prevent an undesired loosening, the rib 9 between its high level section 10 and low level section 11 is formed as a section 14 preventing the cutting element from falling out.

In FIG. 6 the cutting element 3 is shown as an individual part. The already mentioned second guide means 8 is realised as cams 15, which enclose pair-wise the first guide means 7 of the rib 9 and thus form a forced guidance. Three such pairs of cams 16 are formed distributed over the circumference of the cutting element 3, whereby a sufficiently good guidance of the cutting element is ensured. A detailed view of such a pair of cams 16 can be seen in FIG. 7. The lower cam 15 coming into contact with the underneath of the rib 9 is partially formed as a rounded contour 17, so that different sections of the rib 9 can be traversed as smoothly as possible.

FIG. 8 shows the closure cap 4 as an individual part. Drive flanks 18 are formed on the inner surface of the cover surface, which act on drive elements 19, which are formed as webs, projecting on the inside of the cutting element 3 (see FIG. 6). The closure cap 4 is thereby coupled to the cutting element 3 and the desired force and torque transmission can take place.

The invention claimed is:

1. A pouring element for a composite packaging, in particular for a beverage carton for liquid foods, with a basic body comprising a fastening flange and a pouring tube, a cutting element arranged and guided in the pouring tube, first guide means formed in the pouring tube and at least one pair of cams formed on the cutting element, wherein the first guide means and the at least one pair of cams cooperate correspondingly, wherein the first guide means is formed by a surrounding and self-contained rib.

2. The pouring element according to claim 1, wherein the rib for the initial position of the cutting element comprises at least one high level section.

3. The pouring element according to claim 1, wherein the rib for the end position of the cutting element comprises at least one low level section.

4. The pouring element according to claim 1, wherein the rib has different pitches for different movements of the cutting element.

5. The pouring element according to claim 4, wherein the rib between a high level section and low level section comprises a further level for a pure rotational movement of the cutting element.

6. The pouring element according to claim 4, wherein the rib between the high level section and low level section comprises a section to prevent the cutting element from falling out.

7. The pouring element according to claim 1, wherein the at least one pair of cams are arranged over the circumference of the cutting element.

8. The pouring element according to claim 7, wherein three pairs of cams are arranged distributed over the circumference of the cutting element.

9. The pouring element according to claim 7, wherein at least one cam comes into contact via a rounded contour with the rib.

10. The pouring element according to claim 1, wherein a closure cap is connected to the basic body.

11. The pouring element according to claim 10, wherein the cutting element can be driven over drive flanks formed on the closure cap.

12. The pouring element according to claim 11, wherein the drive flanks act on drive elements arranged on the cutting element.

13. The pouring element according to claim 12, wherein the drive elements are formed as webs.

14. A composite packaging, in particular a beverage carton for liquid food stuffs, with a packaging gable panel suitable for accommodating a pouring element, wherein the packaging gable element has a local packaging material weakness, and the pouring element according to claim 1 is positioned and permanently connected so that during the first actuation of the pouring element the cutting element is movable in the direction of the packaging material weakness and this can be severed so that the composite packaging is ready for emptying the contents.

15. The composite packaging according to claim 14, wherein the packaging material weakness is formed as a prelaminated hole.

* * * * *